US006557221B2

(12) United States Patent
Cox et al.

(10) Patent No.: US 6,557,221 B2
(45) Date of Patent: May 6, 2003

(54) CREMATION CONTAINER FOLDABLE INTO COMPACT CONFIGURATION FOR SHIPPING

(75) Inventors: Grayson Cox, Batesville, IN (US); George Hagan, Batesville, IN (US); Tom Heil, Batesville, IN (US); Don Maple, Batesville, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 09/970,834

(22) Filed: Oct. 4, 2001

(65) Prior Publication Data

US 2002/0053120 A1 May 9, 2002

Related U.S. Application Data

(63) Continuation-in-part of application No. 09/493,919, filed on Jan. 28, 2000, which is a continuation-in-part of application No. 09/312,301, filed on May 14, 1999, now Pat. No. 6,202,270.

(60) Provisional application No. 60/125,273, filed on Mar. 19, 1999.

(51) Int. Cl.[7] ..... A61G 17/00

(52) U.S. Cl. ..... 27/4; 27/1; 27/10; 220/4.33; 220/7

(58) Field of Search ..... 27/4, 1, 2, 10, 27/35; 220/4.28, 4.33, 6, 7, 622; 217/12 R, 13, 15, 65, 62; 229/198.1, 198.3, 125.12, 199

(56) References Cited

U.S. PATENT DOCUMENTS

| | | | | | |
|---|---|---|---|---|---|
| 414,177 | A | * | 10/1889 | Snow | 217/62 |
| 621,044 | A | * | 3/1899 | Deerwester | 220/7 |
| 1,003,107 | A | | 9/1911 | Heyman | |
| 1,378,614 | A | | 5/1921 | McLeod et al. | |
| 1,828,088 | A | * | 10/1931 | Robinson | 220/683 |
| 1,989,962 | A | | 2/1935 | Zinser et al. | |
| 2,180,229 | A | * | 11/1939 | Frakes | 217/5 |
| 2,221,504 | A | | 11/1940 | Beasley et al. | |
| 2,914,210 | A | * | 11/1959 | Paston | 220/6 |
| 3,266,656 | A | * | 8/1966 | Kridle | 220/4.28 |
| 3,570,698 | A | | 3/1971 | Dougherty | |
| 3,989,157 | A | | 11/1976 | Veenema | |
| 4,135,279 | A | | 1/1979 | Covington | |
| 4,151,630 | A | | 5/1979 | Havey | |
| 4,214,669 | A | | 7/1980 | McQuiston | |
| 4,517,713 | A | | 5/1985 | Swallert | |
| 4,807,808 | A | * | 2/1989 | Reed | 229/103 |

(List continued on next page.)

FOREIGN PATENT DOCUMENTS

| | | |
|---|---|---|
| GB | 233946 | 5/1925 |
| GB | 517616 | 2/1940 |
| GB | 1057318 | 2/1967 |

*Primary Examiner*—William Miller
(74) *Attorney, Agent, or Firm*—Wood, Herron & Evans, LLP

(57) ABSTRACT

A cremation container foldable into a compact configuration for shipping purposes and unfoldable and erectable at its destination comprises a bottom, a pair of side walls pivoted relative to the bottom, a pair of end walls pivoted relative to the bottom, an angle interconnecting adjacent end edges of adjacent ones of the side and end walls, and a cover removably positionable atop the pair of side walls and end walls. Each angle includes slotted legs which receive adjacent end edges of adjacent ones of the side and end walls. Each slotted leg of each angle includes a dowel pin extending transversely therethrough, and a top edge of each of the adjacent end edges of the adjacent ones of the side and end walls includes a notch therein for receiving a respective dowel pin. Handles are secured to the side base mold frame members. Each of a pair of covers comprises opposed sides and opposed ends and a depending lip secured to each opposed side but to only one end.

15 Claims, 17 Drawing Sheets

U.S. PATENT DOCUMENTS 5,036,979 A * 8/1991 Selz ..... 206/512
5,037,027 A * 8/1991 Nichols ..... 229/198.1
5,253,763 A * 10/1993 Kirkley et al. ..... 206/600
5,307,545 A 5/1994 Stoltz
5,429,261 A * 7/1995 Machino ..... 220/7
5,431,336 A * 7/1995 Clee ..... 229/199
5,586,679 A 12/1996 Thomas
5,622,276 A 4/1997 Simmons
5,638,973 A * 6/1997 Dewey et al. ..... 220/4.33
5,661,879 A 9/1997 Kelly
5,709,016 A 1/1998 Gulick et al.
5,720,403 A * 2/1998 Sawyer ..... 217/65
5,722,551 A 3/1998 Cocciemiglio, Jr.
5,813,100 A * 9/1998 MacKirdy ..... 27/6
5,960,978 A 10/1999 Jenkins
5,964,014 A 10/1999 Wang et al.
5,996,828 A * 12/1999 Cheyn ..... 220/4.33

* cited by examiner

CREMATION CONTAINER FOLDABLE INTO COMPACT CONFIGURATION FOR SHIPPING

RELATED APPLICATIONS

This application is a continuation-in-part application of U.S. application Ser. No. 09/493,919 filed Jan. 28, 2000, which is a continuation-in-part application of U.S. application Ser. No. 09/312,301 filed May 14, 1999, now U.S. Pat. No. 6,202,270, which is a continuation-in-part application of U.S. provisional application Serial No. 60/125,273 filed Mar. 19, 1999, all of which are hereby incorporated by reference herein as if fully set forth in their entirety.

FIELD OF THE INVENTION

This invention relates generally to caskets, and more particularly to that type of casket known as a cremation container.

BACKGROUND OF THE INVENTION

Caskets have traditionally been employed for burial of the dead, both for in-ground burial and above-ground interment. Caskets are normally fabricated from fine furniture-grade wood or from highly polished/finished sheet metal for aesthetic reasons. Cremation containers, or so-called "alternative containers" as they are termed in the death care industry, are on the other hand fabricated of cardboard, hardboard or plywood, and as such are usually much less ornate and hence much less expensive than wood or metal caskets. These containers are generally employed as containers for the dead for which the family has chosen cremation as the means of ultimate disposition of the body. Both caskets and cremation containers traditionally include a lower shell or body containing portion and an upper cap or lid portion closeable on the lower portion. Due to their size and shape neither caskets nor cremation containers are cost-effectively shipped.

Efforts at increasing the cost-effectiveness of shipping caskets and cremation containers have been directed toward the design and development of so-called "knock-down" or "ready-to-assemble" caskets, that is to say, caskets which are shipped in a non-erected, compact package which are then erected at the shipping destination. A major goal of designers of such knock-down caskets has been to produce designs which are relatively quickly and simply erected with few or no tools being required. Success in this area has been more readily achieved in the case of cremation containers rather than in caskets, as cremation containers are by their very nature much less expensive than caskets and as such the fabrication techniques employed in knock-down designs detract from their appearance to a much lesser degree than do they from caskets.

One example of a knock-down or ready-to-assemble casket or cremation container is disclosed in the assignee's U.S. Pat. No. 5,709,016, hereby incorporated by reference herein as if fully set forth in its entirety. Other examples of knock-down or ready-to-assemble caskets or cremation containers are disclosed in the assignee's aforementioned U.S. Patent Applications Serial No. 60/125,273, 09/312,301 and 09/493,919, incorporated by reference hereinabove.

It is desirable to improve upon the design of the caskets and cremation containers in the assignee's '016 patent and '273, '301 and '919 patent applications, as particularly relates to cremation containers.

SUMMARY OF THE INVENTION

In accordance with the principles of the present invention, a cremation container is provided which is foldable into a compact configuration for shipping. The cremation container comprises a bottom, a pair of side walls pivoted relative to the bottom, a pair of end walls pivoted relative to the bottom, an angle interconnecting adjacent end edges of adjacent ones of the side and end walls, and a cover removably positionable atop the pair of side walls and end walls. Each angle includes slotted legs which receive adjacent end edges of adjacent ones of the side and end walls.

One pair of the pair of side walls and pair of end walls is foldable onto the bottom, and the other pair of the pair of side walls and pair of end walls is foldable onto the one pair to compactly configure the container for shipping. Preferably, the pair of side walls are foldable onto the bottom and the pair of end walls are foldable onto the pair of side walls for shipping.

The cremation container further preferably comprises a pair of side base mold frame members and a pair of end base mold frame members. The bottom preferably comprises a panel with peripheral side and end edges which are retained in grooves in the pair of side base mold frame members and in the pair of end base mold frame members, respectively.

Each of the pair of end walls preferably comprises an upper and a lower panel hingedly connected together. An end top mold frame member is preferably secured to an upper edge of the upper panel, and the lower panel is preferably secured to the end base mold frame member.

The upper and lower end wall panels are preferably hingedly connected together via a cardboard living hinge.

Each of the pair of side walls likewise preferably comprises an upper and a lower panel hingedly connected together. A side top mold frame member is preferably secured to an upper edge of the upper panel, and the lower panel is preferably secured to the side base mold frame member.

As with the end wall panels, the upper and lower side wall panels are preferably hingedly connected together via a cardboard living hinge.

Each angle preferably abuts adjacent ones of the side and end base mold frame members and adjacent ones of the side and end top mold frame members.

Each slotted leg of each angle preferably includes a dowel pin extending transversely therethrough. A top edge of each of the adjacent end edges of the adjacent ones of the side and end panels includes a notch therein for receiving a respective dowel pin.

Handles are preferably secured to the side base mold frame members.

The cover preferably comprises a pair of covers, each of which comprises opposed sides and opposed ends, and a depending lip secured to each opposed side but to only one end.

These and other features and advantages of the present invention will become more readily apparent during the following detailed description taken in conjunction with the drawings herein, in which:

DETAILED DESCRIPTION OF THE INVENTION

Figure 1:
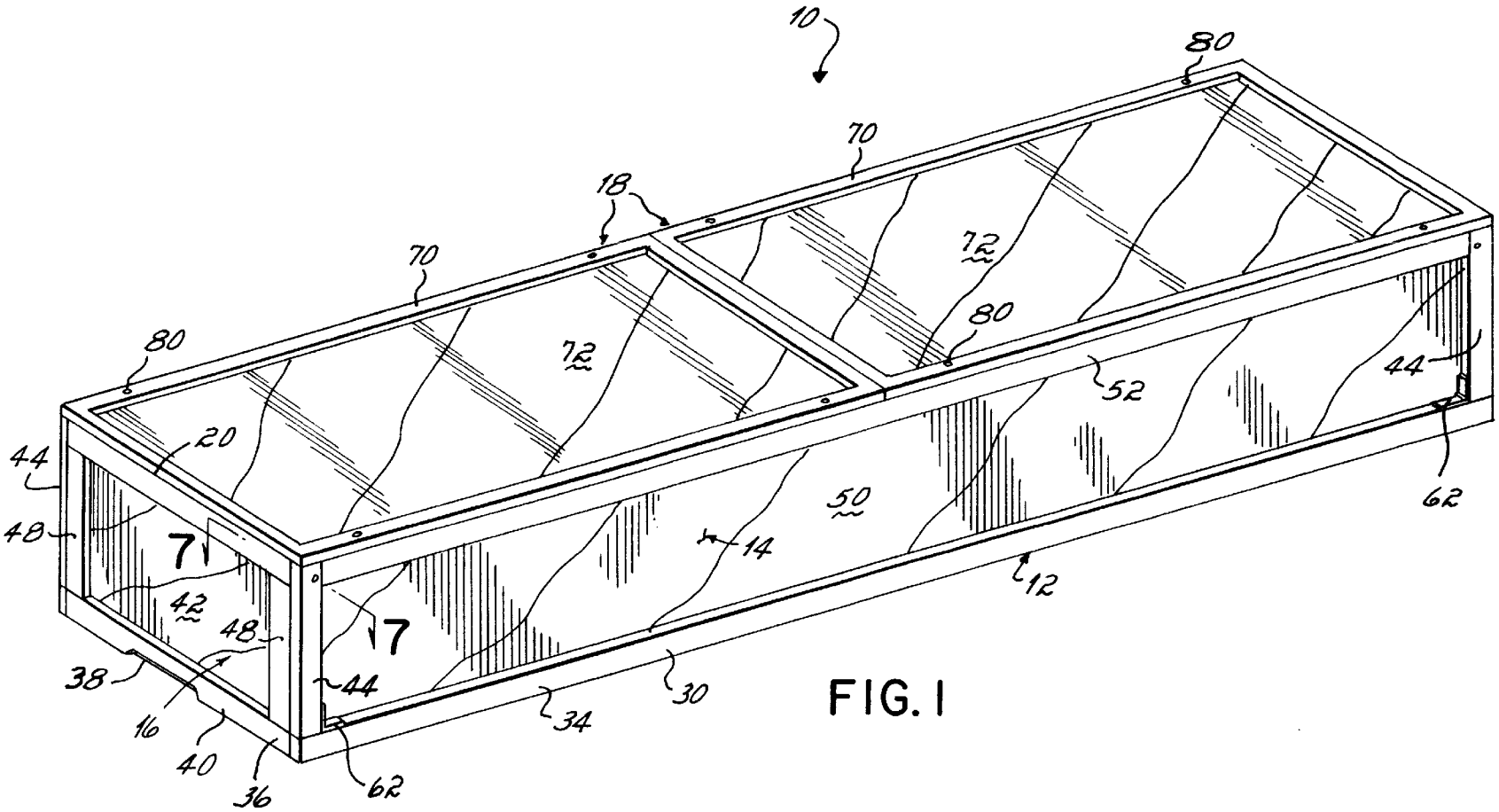
FIG. 1 is a perspective view of the erected cremation container of the present invention.

Referring first to FIG. 1, there is illustrated a cremation container 10 according to the principles of the present invention. The cremation container 10 is foldable into a compact configuration for shipping, and is erected at its destination. The container 10 includes a bottom 12, a pair of Side walls 14, 14 pivotally connected to the bottom 12, a pair of end walls 16, 16 pivotally connected to the bottom 12, and a pair of equal length covers 18, 18 positionable atop the pair of side walls 14, 14, and the pair of end walls 16, 16. One pair of the pair of side walls 14, 14 and the pair of end walls 16, 16 is foldable onto the bottom 12, and the other pair of the pair of side walls 14, 14 and the pair of end walls 16, 16 is being foldable onto the one pair of the pair of side walls 14, 14 and the pair of end walls 16, 16, to thereby compactly configure the container for shipping.

Figure 2:
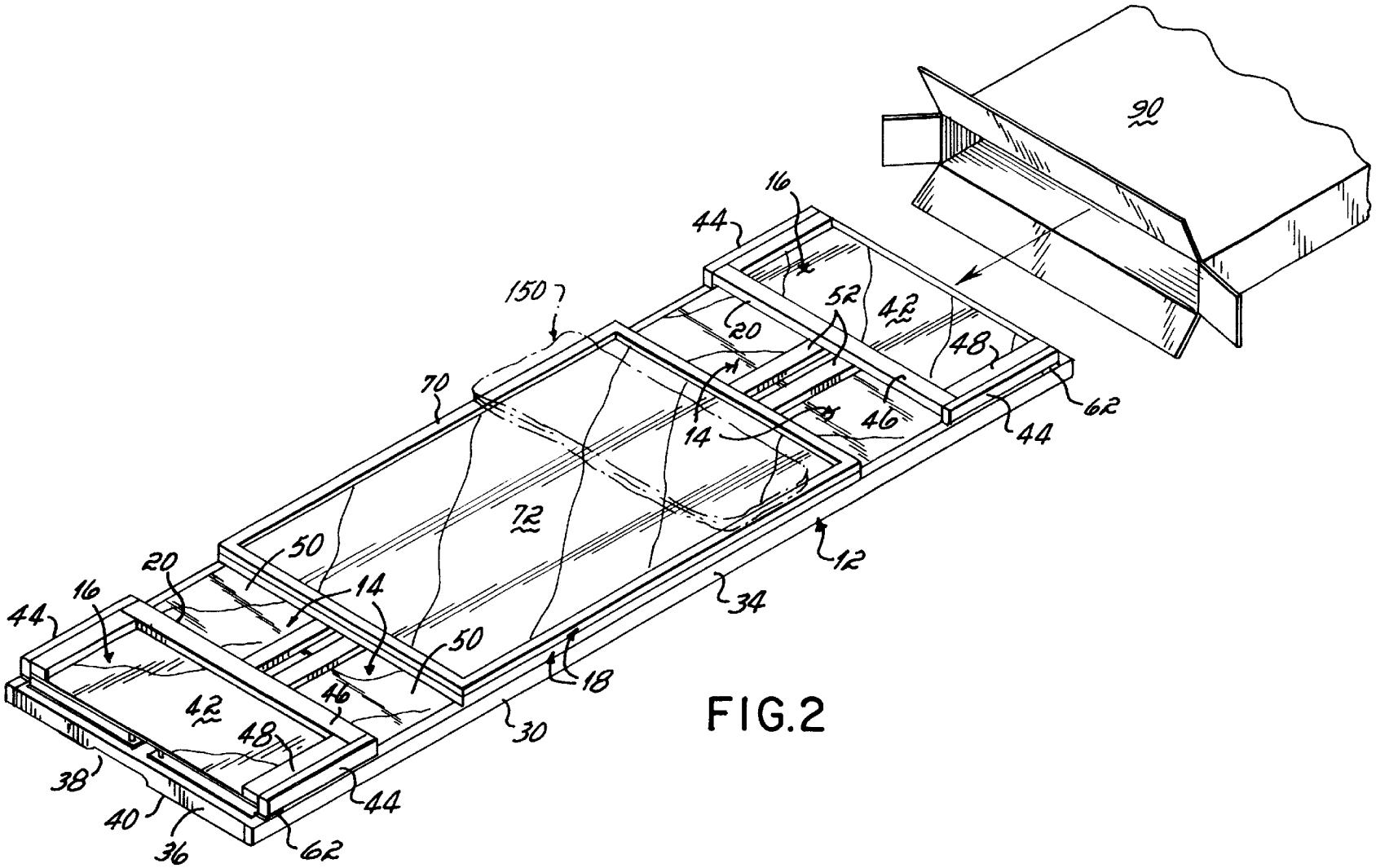
FIG. 2 is perspective view of the cremation container of FIG. 1 folded into its shipping configuration and illustrated being removed from its shipping container.
Figure 3:
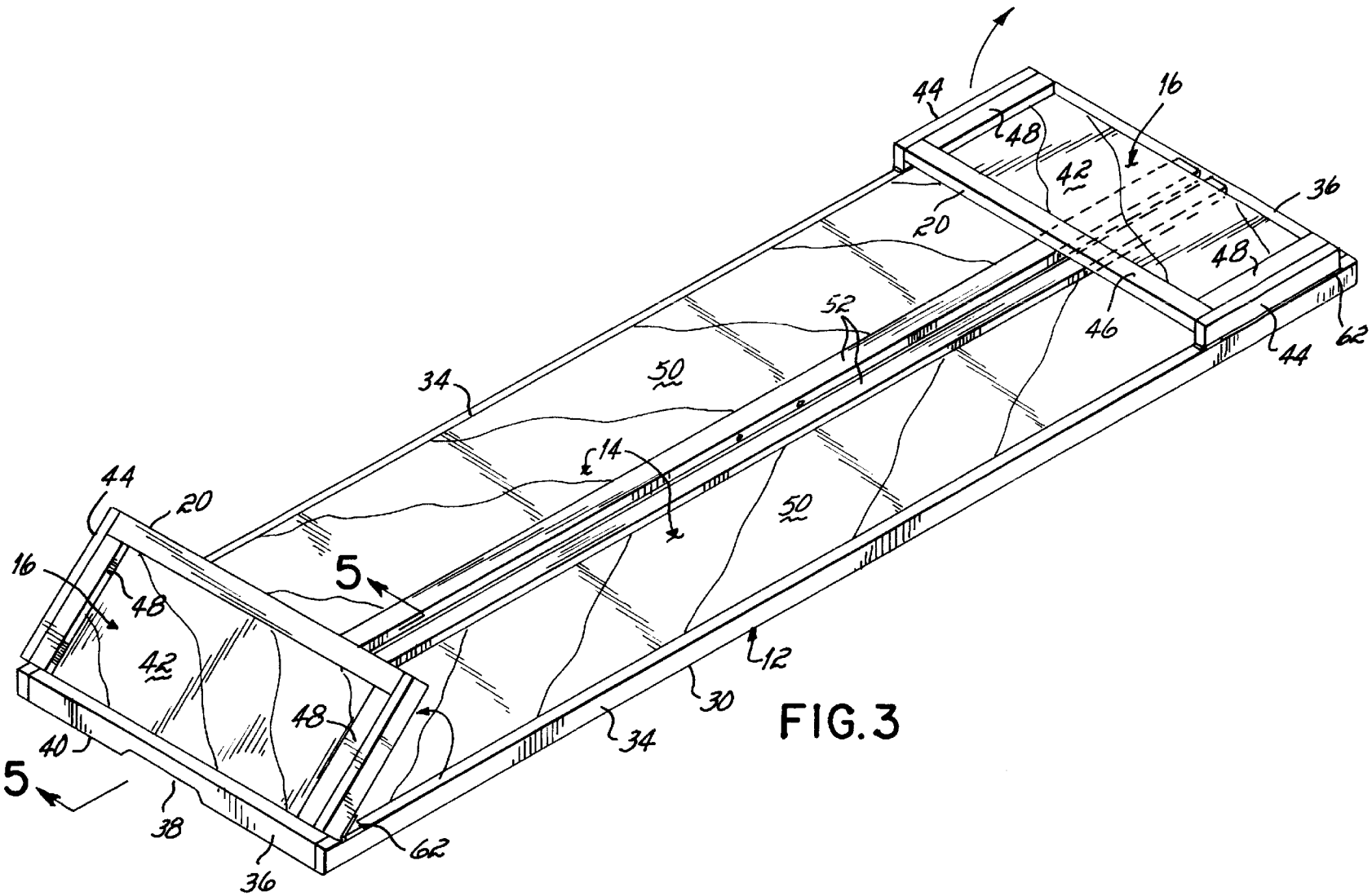
FIG. 3 is a perspective view of the cremation container of FIG. 2 illustrating the step of unfolding the pair of end walls.
Figure 4:
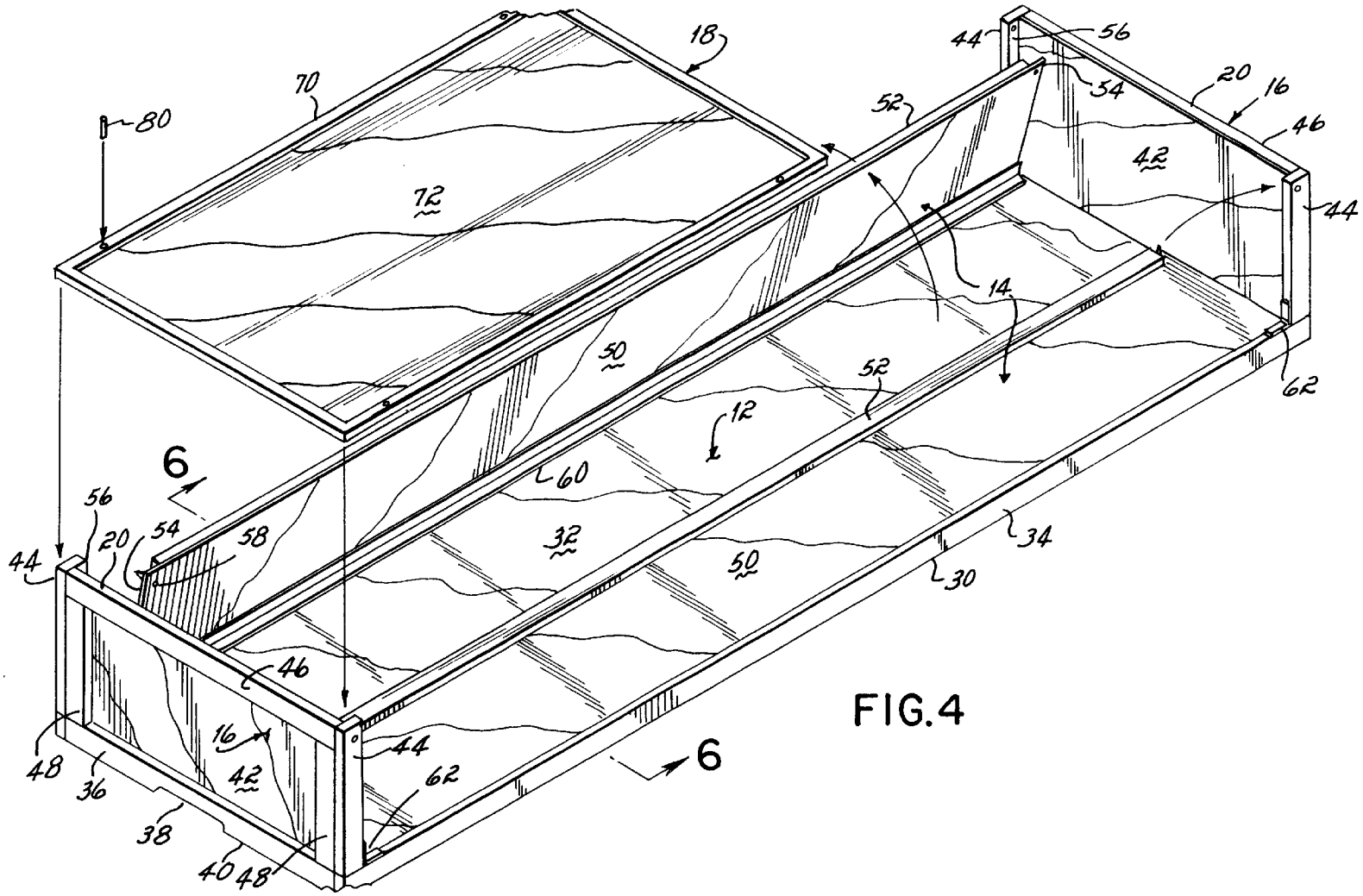
FIG. 4 is a perspective view of the cremation container of FIG. 3 with end walls unfolded and illustrating the step of unfolding the pair of side walls and installing the lids.
Figure 5:
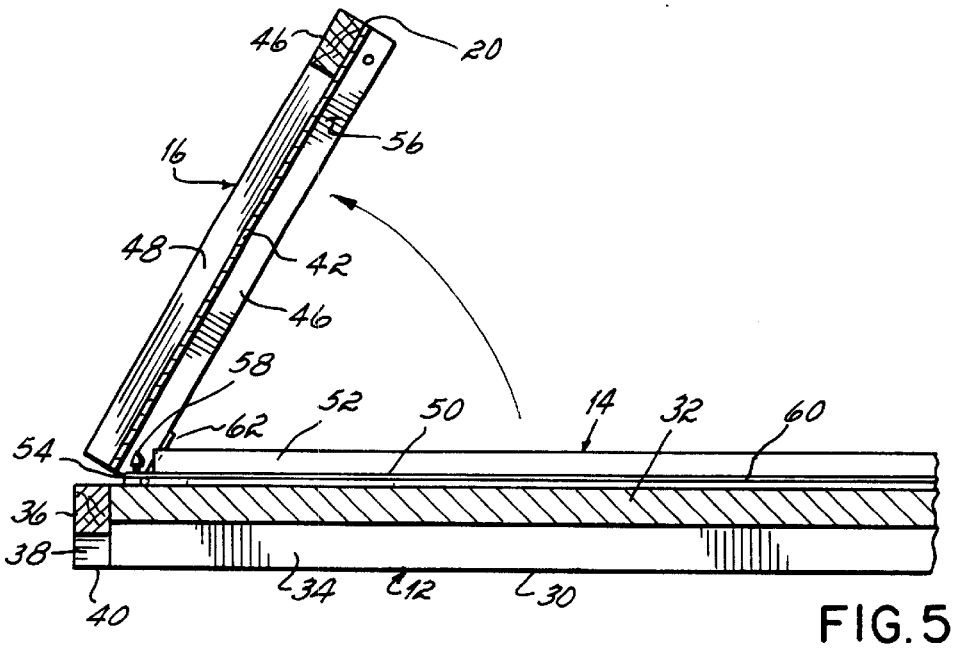
FIG. 5 is a cross-sectional view taken along line 5—5 of FIG. 3.
Figure 6:
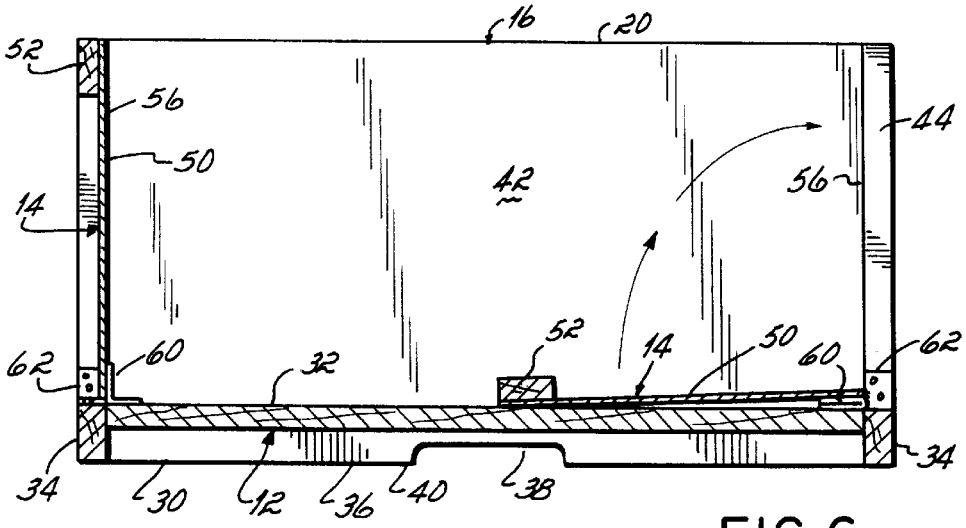
FIG. 6 is a cross-sectional view taken along line 6—6 of FIG. 4.

Referring now to FIG. 2, it will be seen that, in the preferred embodiment of the present invention, the pair of side walls 14, 14 are foldable onto the bottom 12 and the pair of end walls 16, 16 are foldable onto the pair of side walls 14, 14. The pair of lids 18, 18 are of equal length and are positionable on the pair of side walls 14, 14 when the pair of side walls 14, 14 are folded onto the bottom 12, and are positionable between the free edges 20, 20 of the pair of end walls 16, 16 when the pair of end walls 16, 16 are folded onto the pair of side walls 14, 14.

Referring now to FIGS. 1–4, the bottom 12 comprises a rectangular frame 30 and a panel 32 secured to the frame 30. The frame 30 is preferably fabricated of cottonwood, and the panel 32 is preferably fabricated of oriented strand board. The oriented strand board panel 32 is preferably secured to the rectangular cottonwood frame 30 with wood glue. The rectangular frame 30 comprises a pair of side frame members 34, 34, and a pair of end frame members 36, 36. Each of the pair of end frame members 36, 36 includes a cutout 38 therein extending upwardly from a lower edge 40 thereof which serves as a handhold.

Each of the pair of end walls 16, 16 comprises a panel 42, a pair of lateral edge frame members 44, 44 one of which is secured to each lateral edge of the panel 42, and a top edge frame member 46 secured to the top edge of the panel 42. If desired, additional lateral edge frame members 48, 48 may be secured to the panel 42. The frame members 44, 46, 48 are preferably fabricated of cottonwood and the panel 42 is preferably fabricated of lauan plywood, i.e. that form of thin plywood normally employed as underlayment for flooring. The lauan plywood panel 42 is preferably secured to the cottonwood frame members 44, 46, 48 with wood glue.

Figure 7:
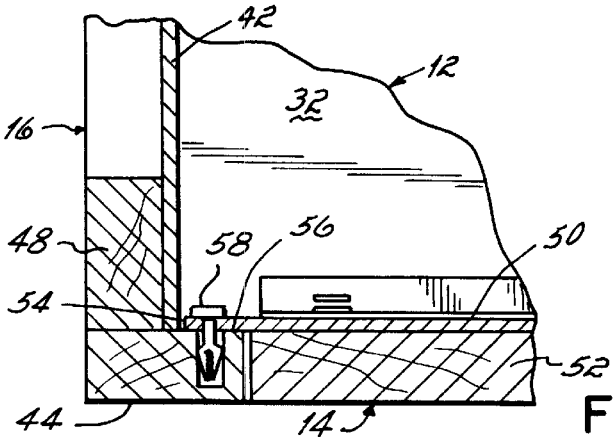
FIG. 7 is a cross-sectional view taken along line 7—7 of FIG. 1.

Each of the pair of side walls 14, 14 comprises a panel 50 and a top edge frame member 52 secured to a top edge of the panel 50. Each frame member 51 is preferably fabricated of cottonwood and each panel 50 is preferably fabricated of lauan plywood. The lauan plywood panel 50 is preferably secured to the cottonwood frame member 52 with wood glue. Each end edge 54 of each side wall panel 50 abuts an inwardly facing surface 56 of a respective end wall lateral edge frame member 44 when assembled. A fastener 58 fastens each end edge 54 of each side wall panel 50 to the respective end wall lateral edge frame member 44. The fastener 58 is preferably a plastic Christmas tree fastener, wherein the end edge 54 of the side wall panel 50 includes a through hole therethrough and the respective end wall lateral edge frame member 44 includes a blind hole therein, such that the Christmas tree fastener passes through the through hole and resides in the blind hole to thereby retain the end edge 54 of the side wall panel 50 against the inwardly facing surface 56 of the respective end wall lateral edge frame member 44. See FIG. 7.

Referring now to all the Figures, each of the pair of side walls 14, 14 is pivotally connected to the bottom 12 with either a cardboard living hinge 60, or alternatively metal hinges (not shown). Each of the pair of end wall 16, 16 are pivotally connected to the bottom 12 with metal hinges 62.

The pair of lids 18 each comprise a rectangular frame 70 and a panel 72 secured to the frame 70. The frame 70 is preferably fabricated of cottonwood and the panel 72 is preferably fabricated of lauan plywood. The lauan plywood panel 72 is preferably secured to the rectangular cottonwood frame 70 with wood glue. The pair of lids 18, 18 are fastened to top edges of the pairs of side walls 14, 14 and pairs of end walls 16, 16 with dowel pins 80.

The foldable cremation container 10 of the present invention is so sized and configured that it readily fits into a standard UPS or Federal Express shipping container 90 shown in FIG. 2.

Referring now to FIGS. 8–11, various aspects of the construction of an alternative embodiment cremation container 100 are illustrated. In this embodiment, various steps have been taken to reduce the cost of the container 100, improve the structural integrity of the container 100 in its erected configuration, and provide protection against body fluids.

More particularly, in the embodiment 100 the frames for the side walls, end walls and covers have been eliminated. Medium density fiberboard ("MDF") has been substituted for the lauan plywood. The bottom remains constructed of oriented strand board ("OSB"). The hinges hinging the side walls and end walls to the bottom remain unchanged.

Figure 8:
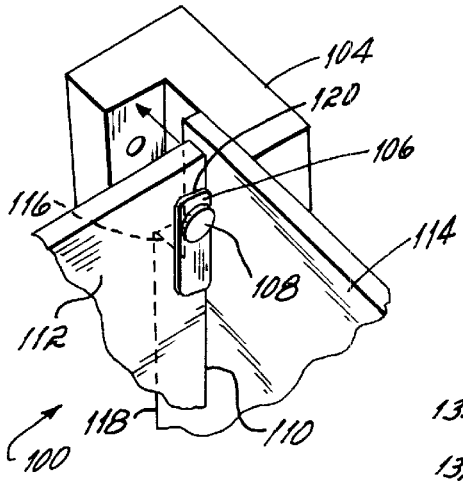
FIG. 8 is a partial perspective view, enlarged, of a corner of an alternative embodiment cremation container illustrating a locking mechanism for locking the side walls in an erected position.
Figure 9:
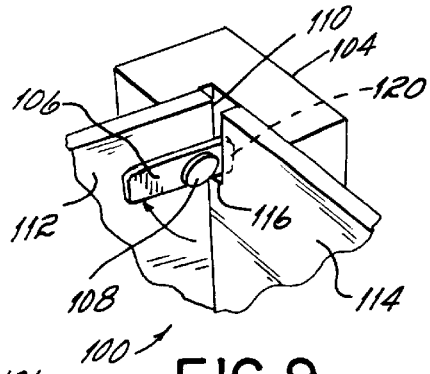
FIG. 9 is a view similar to FIG. 8 with the locking mechanism in the locked position.
Figure 11:
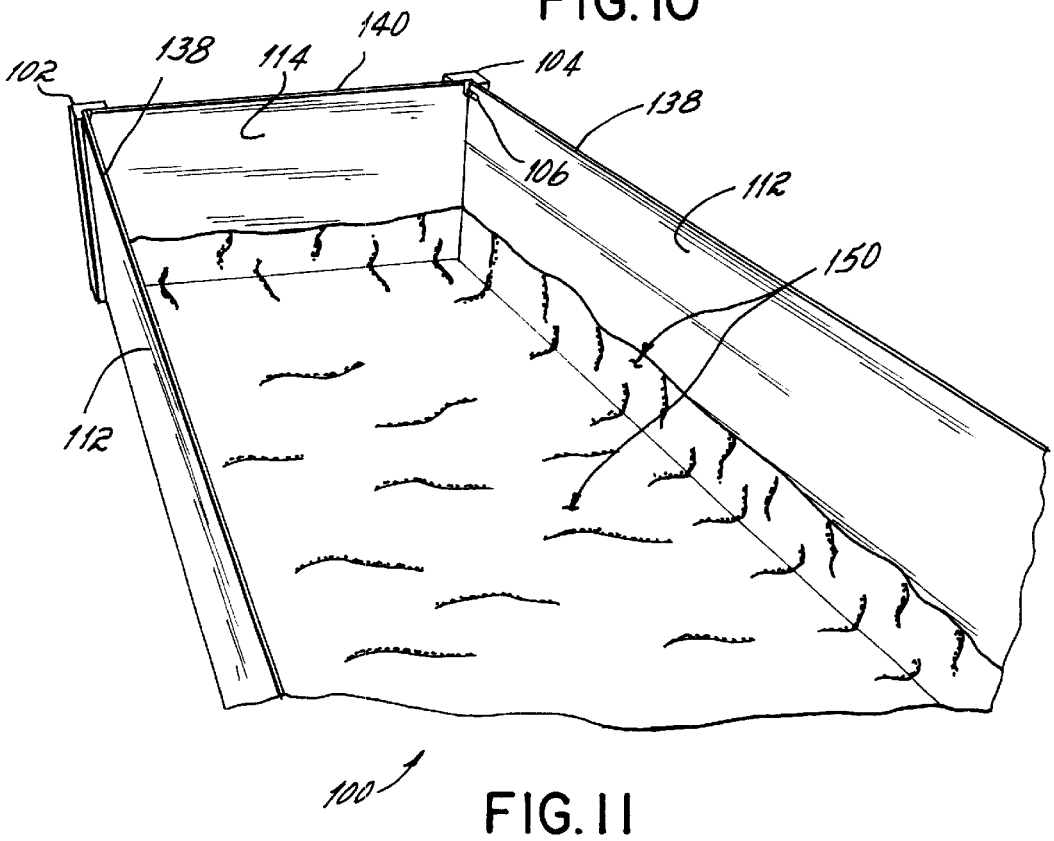
FIG. 11 is a partial perspective view of the container of FIGS. 8–10 illustrating a fluid containment bag placed in the alternative embodiment container.

The alternative embodiment container 100 now includes four L-shaped corner posts, one of which is located at each corner of the container 100, and two of which are illustrated at 102 and 104 (FIG. 11). Referring to FIGS. 8 and 9, a locking lever 106 is pivotally attached with a fastener 108, for instance a friction fit fastener or a barbed plastic fastener known as a plastic Christmas tree fastener, near an end edge 110 of side wall 112. The end wall 114 includes a notch 116 in a lateral edge 118 thereof. As is seen in FIGS. 8 and 9, when side wall 112 is erected, locking lever 106 is rotated clockwise so that its end 120 resides in notch 116 in end wall 114, thus preventing the side wall 112 from collapsing inwardly and downwardly. Locking lever 106 may preferably be fabricated of masonite.

Figure 10:
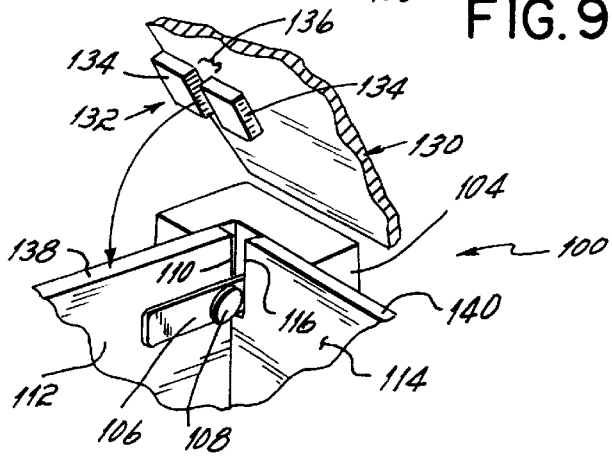
FIG. 10 is a view similar to FIGS. 8 and 9 illustrating another mechanism for securing the covers on the container.

Referring now to FIG. 10, lid 130 now includes a plurality of pairs 132 of cleats 134, 134, for example small wooden blocks screwed to the underneath side lid 130 with wood screws. Respective cleats 134, 134 of each cleat pair 132 are spaced apart at sufficient distance 136 so as to allow the upper edge 138 of side wall 112 and 140 of end wall 114 to fit therebetween in order to secure the cover 130 onto the side and end walls 112, 114.

Referring now to FIG. 11, a liquid impervious liner 150, such as a polyethylene bag, is provided with the alternative embodiment container 100 for placement in the bottom thereof to protect against leakage of body fluids. The liner 150 may be affixed to the interior of the container 100 with, for example, double-sided tape (not shown). The polyethylene bag 150 may simply be folded up and placed on top of the lids 130 in the knocked down configuration of the container 100 for shipment, as is illustrated for example in FIG. 2.

Referring now to FIGS. 12–16, there is illustrated a second alternative embodiment cremation container 200. The container 200 is an improvement over the construction illustrated in FIGS. 1–11 in that the shell, or lower body containment portion of the container 200, requires only five subassembled components and thirty four wood screws for field assembly. The container retain the outside appearance of the prior embodiments, as the construction mate rials are generally the same as in the prior embodiments, but greatly reduces the number of components and fasteners required for field assembly of the prior embodiments (eleven components and 48 fasteners). Thus, the embodiment 200 reduces the likelihood of problems associated with prior container embodiment kits such as missing and/or mismanufactured parts, as well as the time required to assemble the container kit in the field.

More particularly, the container 200 includes a bottom 202, a pair of side walls 204, 206 pivoted relative to the bottom 202, a pair of end walls 208, 210 pivoted relative to the bottom 202, and angles 212, 214, 216, 218 interconnecting adjacent end edges of adjacent ones of the side and end walls (for example, angle 212 interconnects adjacent end edges 204*a*, 208*a* of adjacent side and end walls 204, 208, respectively.) As in the prior embodiments, one pair of the pair of side walls 204, 206 and the pair of end walls 208, 210 is foldable onto the bottom 202, and the other pair of the pair of side walls 204, 206 and the pair of end walls 208, 210 is foldable onto the one pair to compactly configure the container 200 for shipping. Preferably, the pair of side walls 204, 206 are foldable onto the bottom 202 and the pair of end walls 208, 210 are foldable onto the pair of side walls 204, 206, though if desired or required the order of folding could be reversed.

The container 200 further comprises a pair of side base mold frame member 220, 222 and a pair of end base mold frame members 224, 226. The bottom 202 is a panel with a pair of peripheral side edges (one of which is shown at 228 in FIG. 16) and a pair of peripheral end edges (one of which is shown at 230 also in FIG. 16). The peripheral side and end edges of panel bottom 202 are retained in grooves in the pair of side base mold frame members 220, 222 and in the pair of end base mold frame members 224, 226, respectively (see for example groove 232 in side base mold frame member 222 and groove 234 in end base mold frame member 226 in FIG. 16). If desired wood glue can be used to further secure panel bottom 202 in the grooves in the side and end base mold frame members 220, 222, 224, 226.

Figure 16:
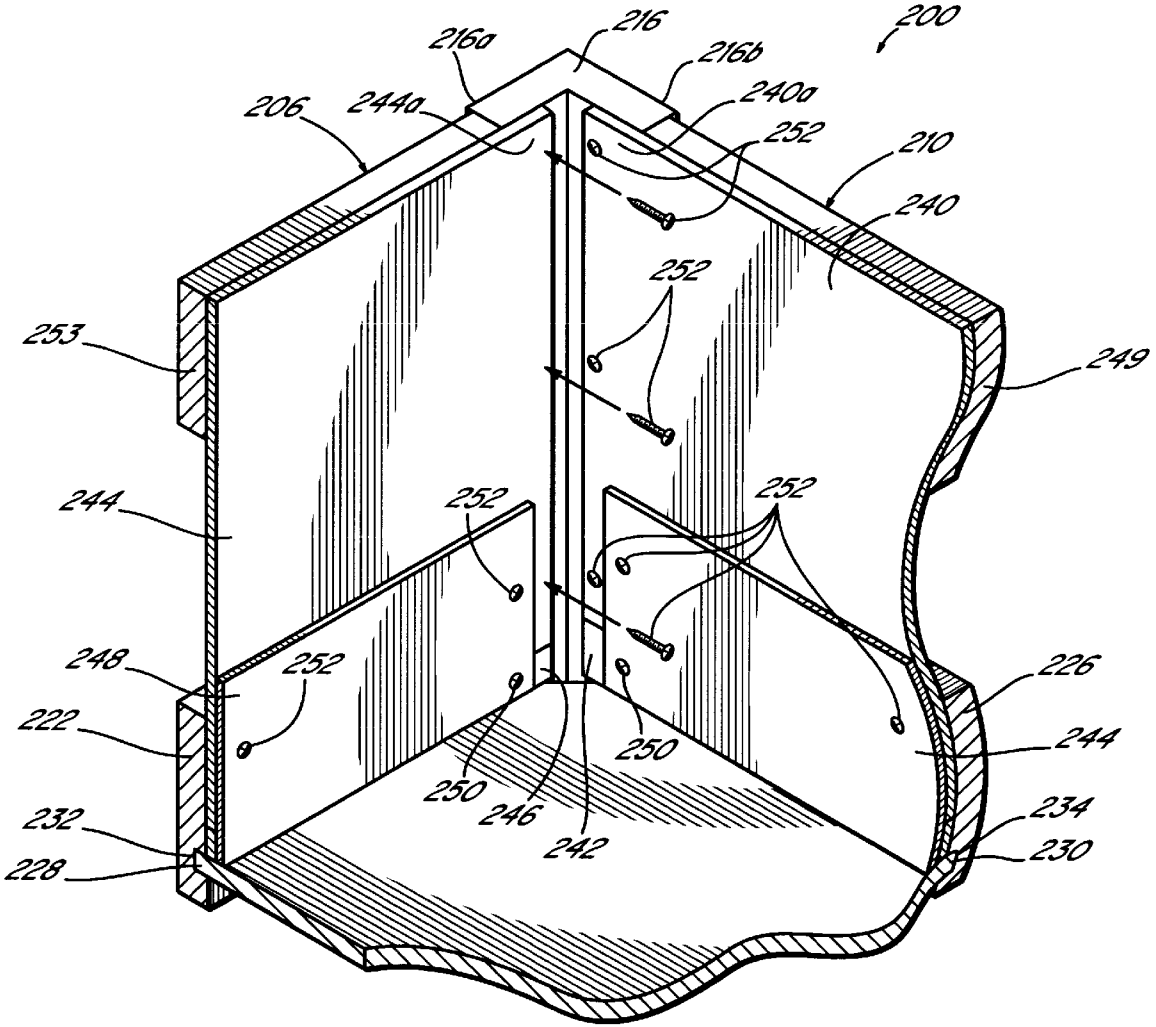
FIG. 16 is a partial perspective view, enlarged, of a corner of the cremation container of FIGS. 12–15 illustrating the installation of screws securing the side wall and end walls to the corner angles.

Each of the pair of end walls 208, 210 comprises an upper end wall panel and a lower end wall panel hingedly connected to the upper end wall panel. See, for example, upper end wall panel 240 and lower end wall panel 242 of end wall 210 shown in FIG. 16. The upper and lower end wall panels, for example 240, 242, are preferably hingedly connected together via a cardboard living hinge 244 (FIG. 16). Other materials other than cardboard can be utilized, for example plastic, etc. Living hinge 244 can be attached to the upper and lower panels 240, 242 by most any suitable fastening means, such as glue, staples, screws, etc.

Similarly, each of the pair of side walls 204, 206 comprises an upper side wall panel and a lower side wall panel hingedly connected to the upper side wall panel. See, for example, upper side wall panel 244 and lower side wall panel 246 of side wall 206 shown in FIG. 16. The upper and lower side wall panels, for example 244, 246, are preferably likewise hingedly connected together via a cardboard living hinge 248 (FIG. 16). Other materials other than cardboard can be utilized, for example, plastic etc. Living hinge 248 can be attached to the upper and lower panels 244, 246 by most any suitable fastening means, such as glue, staples, screws, etc.

Each of the upper end wall panels includes a top mold frame member 247, 249. Each of the upper side wall panels includes a top mold frame member 251, 253. The top mold frame members can be attached to the upper end and side wall panels by most any suitable fastening means, such as glue, screws, etc.

As disclosed, the lower end wall panels are taller than the lower side wall panels to allow the side walls to fold onto the bottom and the end walls to fold Into the folded side walls. If desired or required, the order of folding these walls could be reversed; in that case the side wall panels would need to be taller than the end wall panels.

Figure 12:
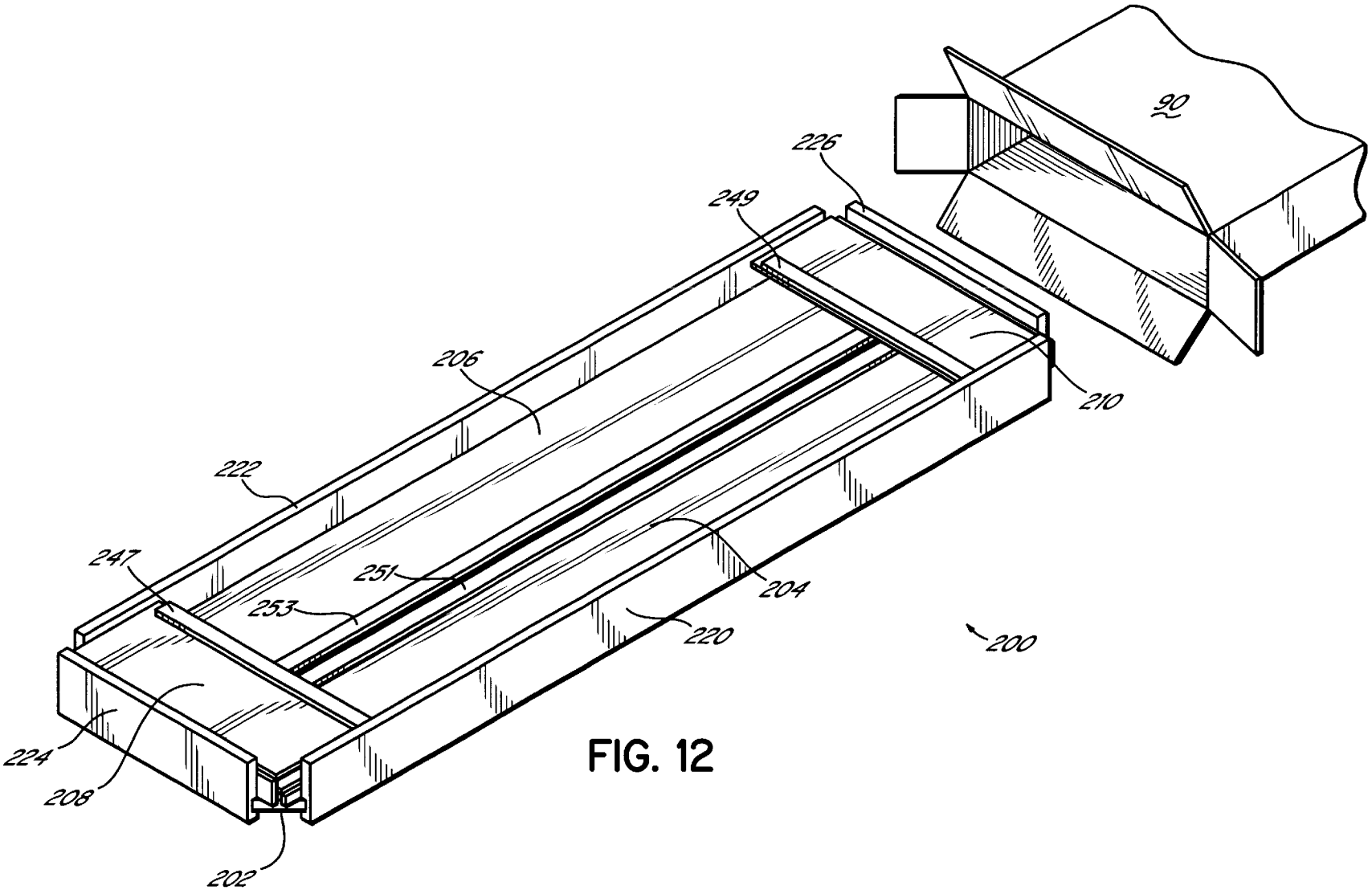
FIG. 12 is a perspective view of a second alternative embodiment of cremation container folded into its shipping configuration and illustrated being removed from its shipping container.
Figure 13:
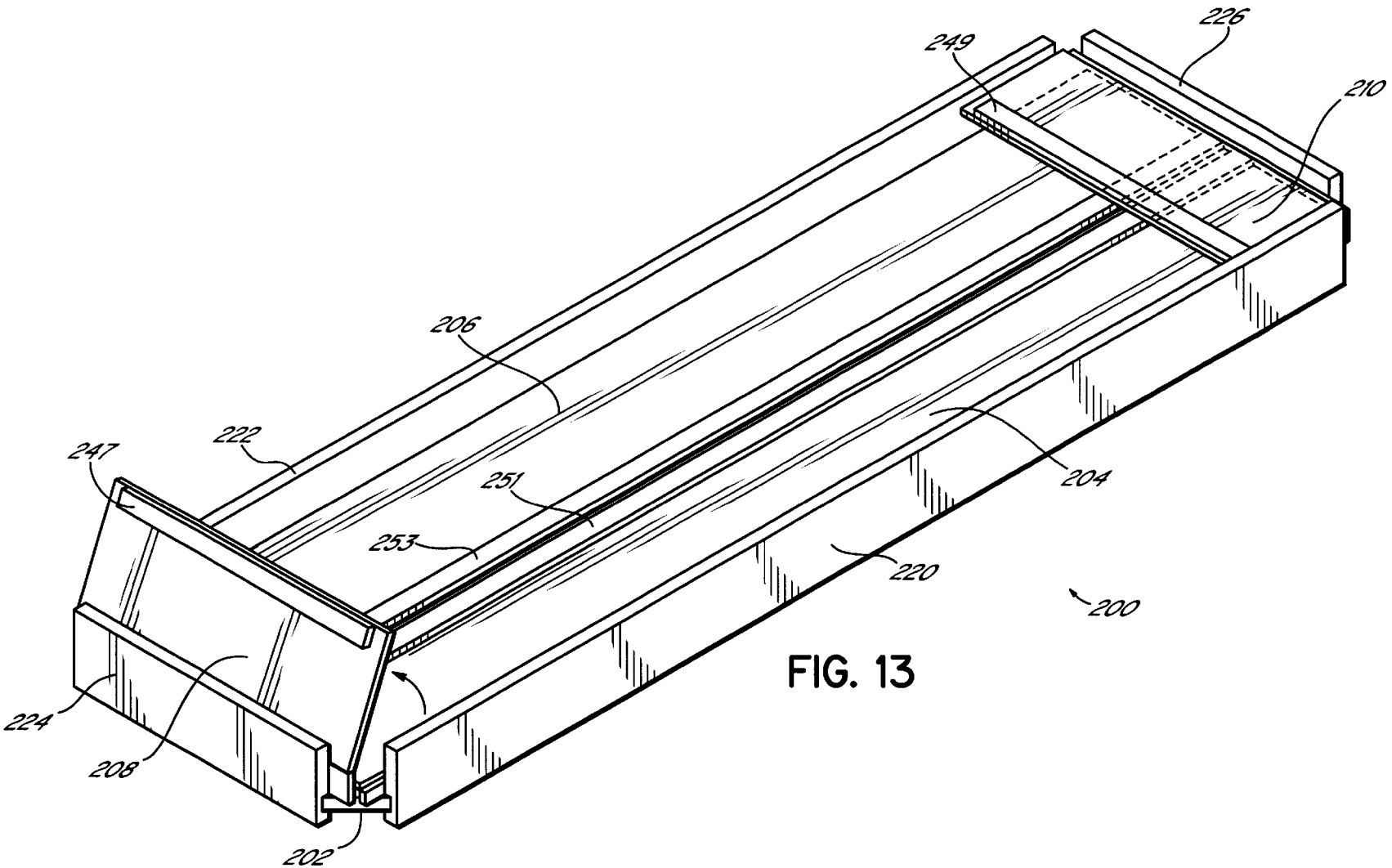
FIG. 13 is a perspective view of the cremation container of FIG. 12 illustrating the step of unfolding the pair of end walls.
Figure 14:
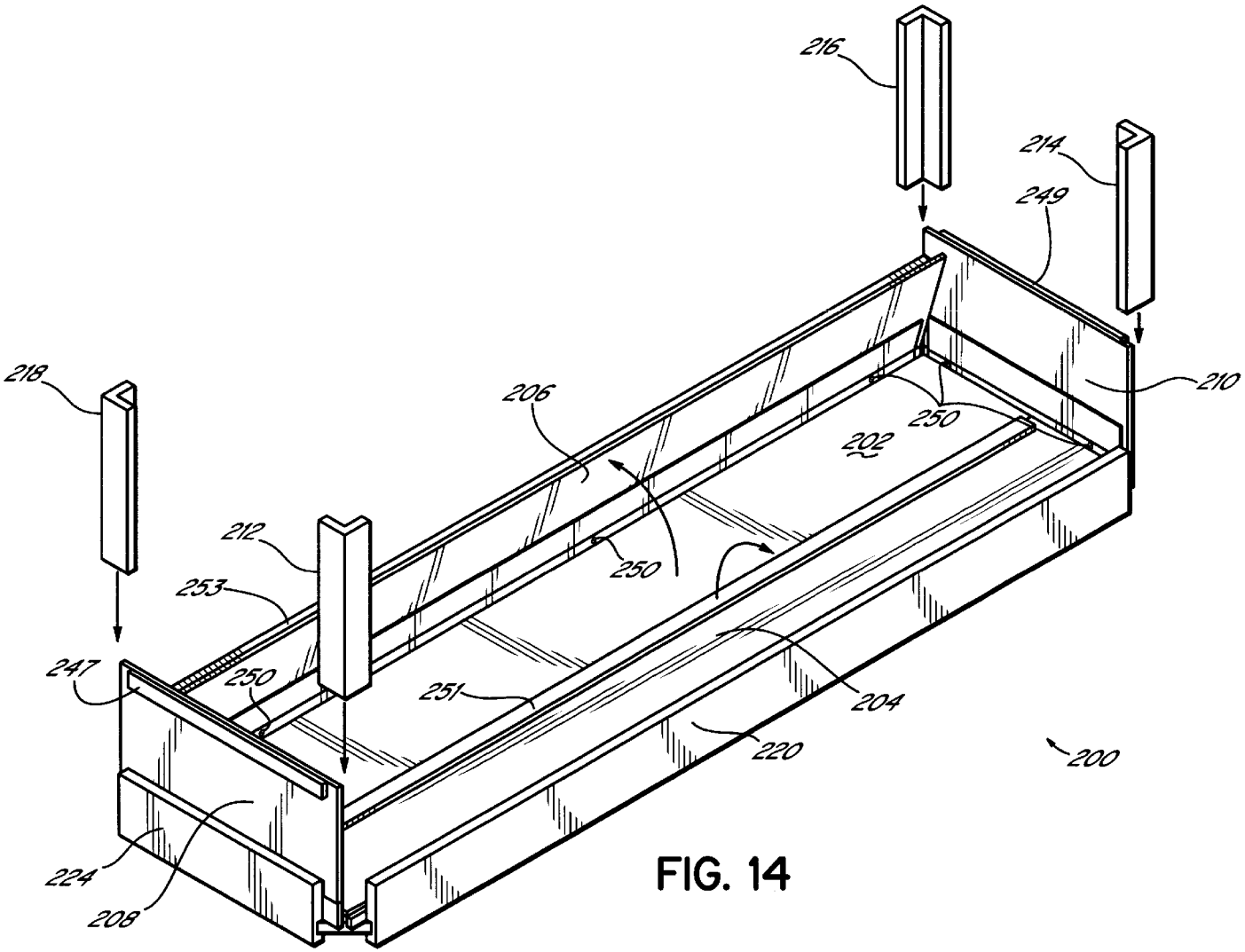
FIG. 14 is a perspective view of the cremation container of FIGS. 12 and 13 with end walls unfolded and illustrating the step of unfolding the pair of side walls and installing the corner angles.
Figure 15:
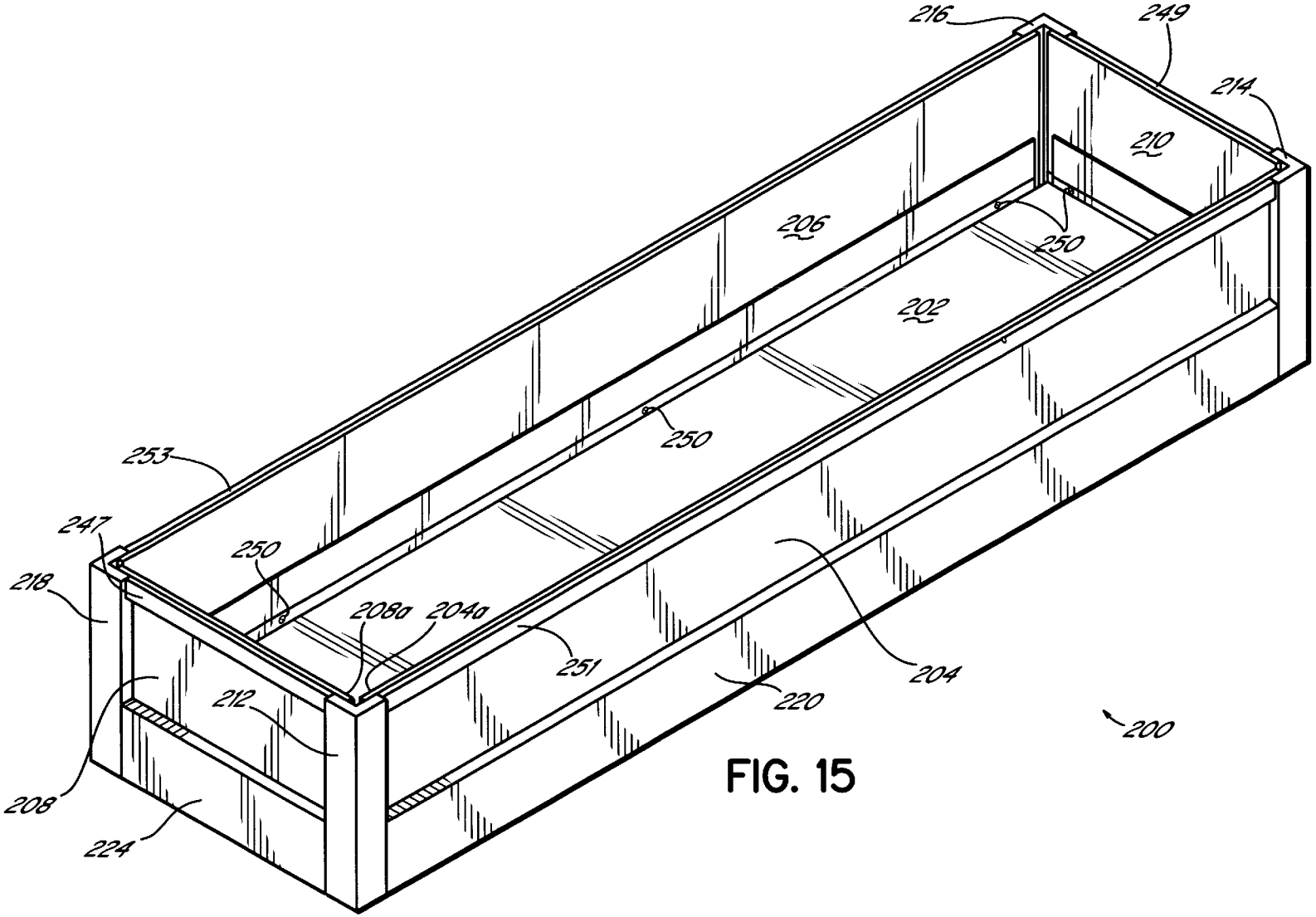
FIG. 15 is a perspective view of the cremation container of FIGS. 12–14 fully erected with corner angles installed.

At the factory or manufacturing facility only the lower panels of the side and end wall 204, 206, 208, 210 are attached to the side and end base mold frame members 220, 222, 224, 226. Most any suitable type of fastener such as wood screws or the like may be used. With only the lower panels of the side and end walls fastened to the side and end base mold frame members, the side and end walls 204, 206, 208, 210 may be folded as illustrated in FIG. 12 for shipping. In the field, that is to say at the funeral home, the folded assembly of bottom 202 and side and end walls 204, 206, 208, 210 is removed from the shipping carton 90 and the end walls 208, 210 are first pivoted upwardly to their upright orientation and then the side walls 204, 206 are pivoted upwardly to their upright orientation. Then the four corner angles 212, 214, 216, 218 are installed as illustrated in FIGS. 14–16.

Referring now specifically to FIG. 16, fasteners such as wood screws 250 are shown which as described above are utilized to secure the lower panels of the side and end walls 204, 206, 208, 210 to the side and end base mold frame members 220, 222, 224, 226 at the factory. To fasten the corner angles, such as angle 216 shown in FIG. 16, to the container 200 preferably three wood screws 252 are used for each wall. For example, as shown in FIG. 16, three wood screws 252 secure end 244*a* of upper panel 244 of side wall 206 to leg 216*a* of angle 216. Similarly, three wood screws 252 secure end 240*a* of upper panel 240 of end wall 210 to leg 216*b* of angle 216. To complete field assembly, preferably two wood screws 252 are used to fasten the upper panels of the end walls 208, 210 to the end base mold frame members 224, 226, such as wood screws 252 shown in FIG. 16 securing upper panel 240 to end base mold frame member 226. And, preferably three wood screws 252 are used to fasten the upper panels of the side walls 204, 206 to the side base mold frame members 220, 222, such as wood screws 252 shown in FIG. 16 securing upper panel 244 of side wall 206 to side base mold frame member 222.

Thus, field assembly of the container 200 requires only that four components (angles) be assembled onto one factory assembled subassembly of bottom 202, side walls 204, 206 and end walls 208, 210 with thirty four screws.

Referring now to FIGS. 17–22, there is illustrated a third alternative embodiment cremation container 300. The container 300 is an improvement over the construction illustrated in FIGS. 12–16 in that the shell, or lower body containment portion of the container 300, does not require any screws to erect the side walls and end walls during field assembly. The container retains the outside appearance of the prior embodiments, as the construction materials are generally the same as in the prior embodiments, but greatly reduces the number of fasteners and fastening steps required for field assembly of the prior embodiments. Thus, the embodiment 300 reduces the likelihood of problems associated with prior container embodiment kits such as missing and/or mis-manufactured parts, as well as the time required to assemble the container kit in the field.

More particularly, the container 300 includes a bottom 302, a pair of side walls 304, 306 pivoted relative to the bottom 302, a pair of end walls 308, 310 pivoted relative to the bottom 302, and angles 312, 314, 316, 318 interconnecting adjacent end edges of adjacent ones of the side and end walls (for example, angle 312 interconnects adjacent end edges 304*a*, 308*a* of adjacent side and end walls 304, 308, respectively.) As in the prior embodiments, one pair of the pair of side walls 304, 306 and the pair of end walls 308, 310 is foldable onto the bottom 302, and the other pair of the pair of side walls 304, 306 and the pair of end walls 308, 310 is foldable onto the one pair to compactly configure the container 300 for shipping. Preferably, the pair of side walls 304, 306 are foldable onto the bottom 302 and the pair of end walls 308, 310 are foldable onto the pair of side walls 304, 306, though if desired or required the order of folding could be reversed.

The container 300 further comprises a pair of side base mold frame members 320, 322 and a pair of end base mold frame members 324, 326. The bottom 302 is a panel with a pair of peripheral side and end edges (see, for example, peripheral side edge 328 and peripheral end edge 330 in FIG. 18). The peripheral side and end edges of panel bottom 302 are retained in grooves in the pair of side base mold frame members 320, 322 and in the pair of end base mold frame members 324, 326, respectively (see, for example, groove 332 in side base mold frame member 320 and groove 334 in end base mold frame member 324 in FIG. 18). If desired wood glue can be used to further secure panel bottom 302 in the grooves in the side and end base mold frame members 320, 322, 324, 326.

Each of the pair of end walls 308, 310 comprises an upper end wall panel and a lower end wall panel hingedly connected to the upper end wall panel. See, for example, upper end wall panel 340 and lower end wall panel 342 of end wall 308 shown in FIG. 18. The upper and lower end wall panels, for example 340, 342, are preferably hingedly connected together via a cardboard living hinge (not shown). Other materials other than cardboard can be utilized, for example plastic, etc. The living hinge can be attached to the upper and lower panels 340, 342 by most any suitable fastening means, such as glue, staples, screws, etc.

Similarly, each of the pair of side walls 304, 306 comprises an upper side wall panel and a lower side wall panel hingedly connected to the upper side wall panel. See, for example, upper side wall panel 344 and lower side wall panel 346 of side wall 304 shown in FIG. 18. The upper and lower side wall panels, for example 344, 346, are preferably likewise hingedly connected together via a cardboard living hinge (not shown). Again, other materials other than cardboard can be utilized, for example, plastic etc. Again, the living hinge can be attached to the upper and lower panels 344, 346 by most any suitable fastening means, such as glue, staples, screws, etc.

Each of the upper end wall panels includes a top mold frame member 347, 349. Each of the upper side wall panels includes a top mold frame member 351, 353. The top mold frame members can be attached to the upper end and side wall panels by most any suitable fastening means, such as glue, screws, etc.

As disclosed, the lower end wall panels are taller than the lower side wall panels to allow the side walls to fold onto the bottom and the end walls to fold onto the folded side walls. If desired or required, the order of folding these walls could be reversed; in that case the side wall panels would need to be taller than the end wall panels.

Figure 17:
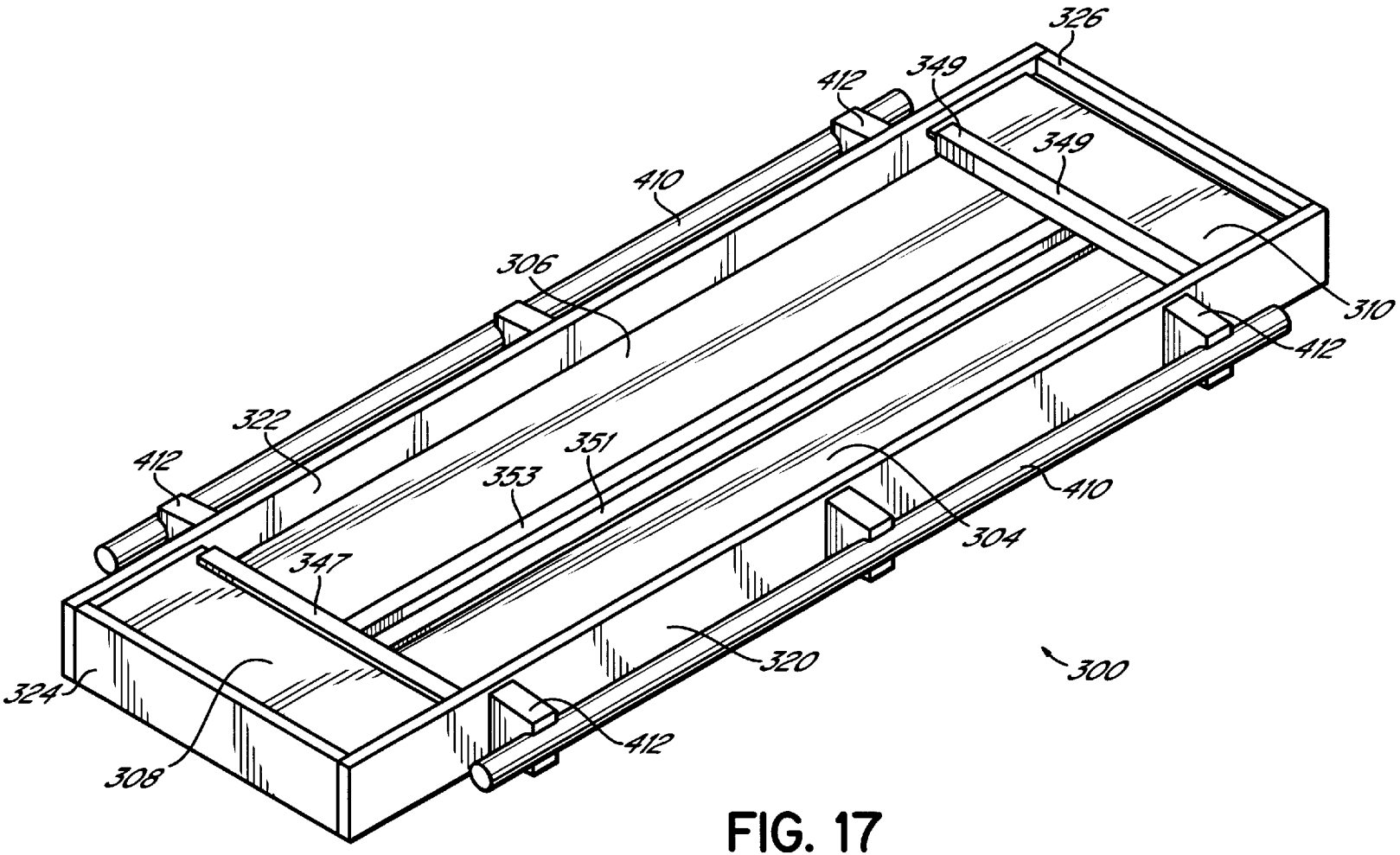
FIG. 17 is a perspective view of a third alternative embodiment of cremation container folded into its shipping configuration.
Figure 18:
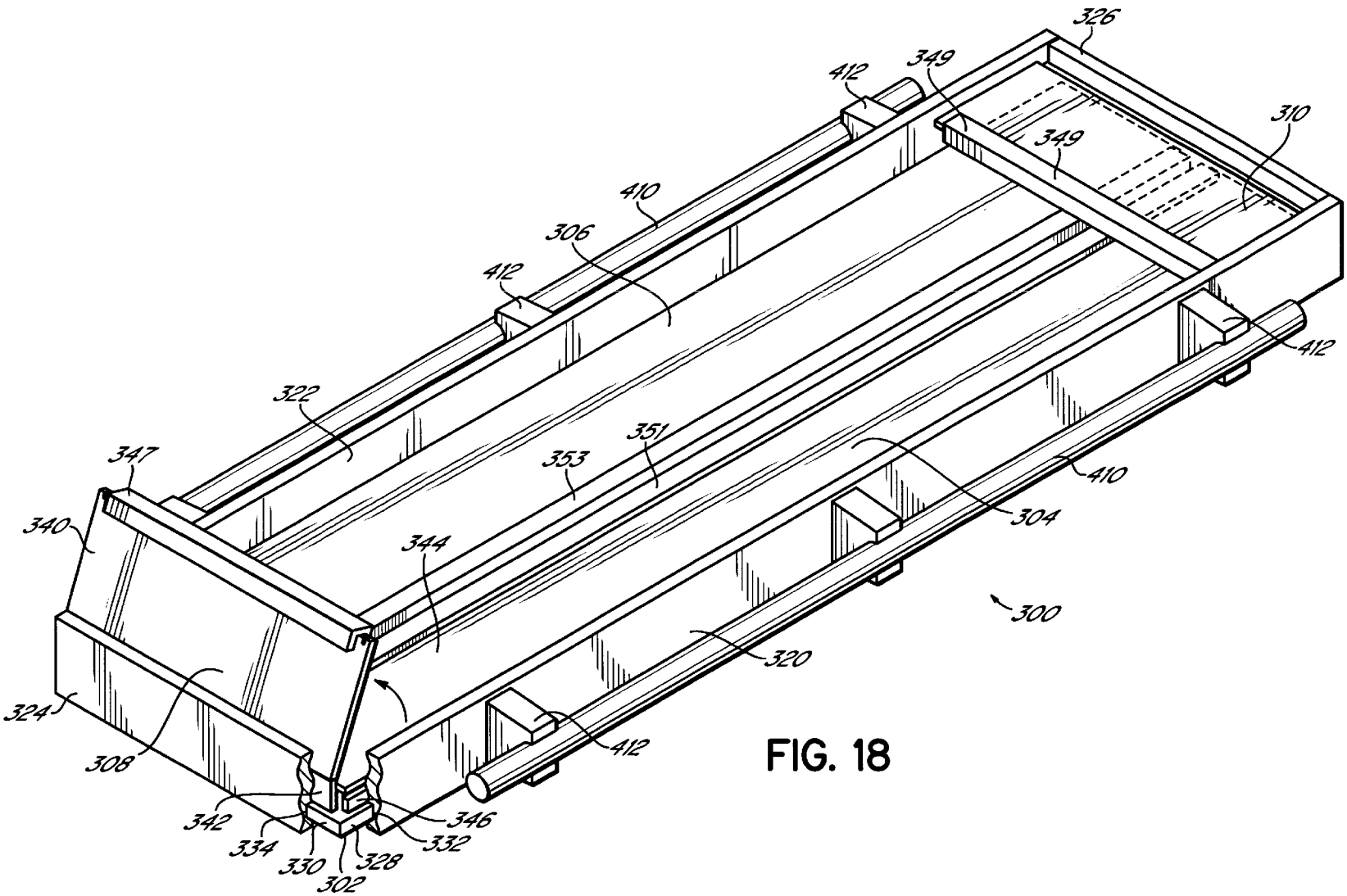
FIG. 18 is a perspective view of the cremation container of FIG. 17 illustrating the step of unfolding the pair of end walls.

At the factory or manufacturing facility only the lower panels of the side and end walls 304, 306, 308, 310 are attached to the side and end base mold frame members 320, 322, 324, 326. Most any suitable type of fastener such as wood screws or the like may be used. With only the lower panels of the side and end walls fastened to the side and end base mold frame members, the side and end walls 304, 306, 308, 310 may be folded as illustrated in FIG. 17 for shipping. In the field, that is to say at the funeral home, the folded assembly of bottom 302 and side and end walls 304, 306, 308, 310 is removed from the shipping carton 90 and the end walls 308, 310 are first pivoted upwardly to their upright orientation and then the side walls 304, 306 are pivoted upwardly to their upright orientation. Then the four corner angles 312, 314, 316, 318 are installed as illustrated in FIGS. 19 and 22.

Figure 19:
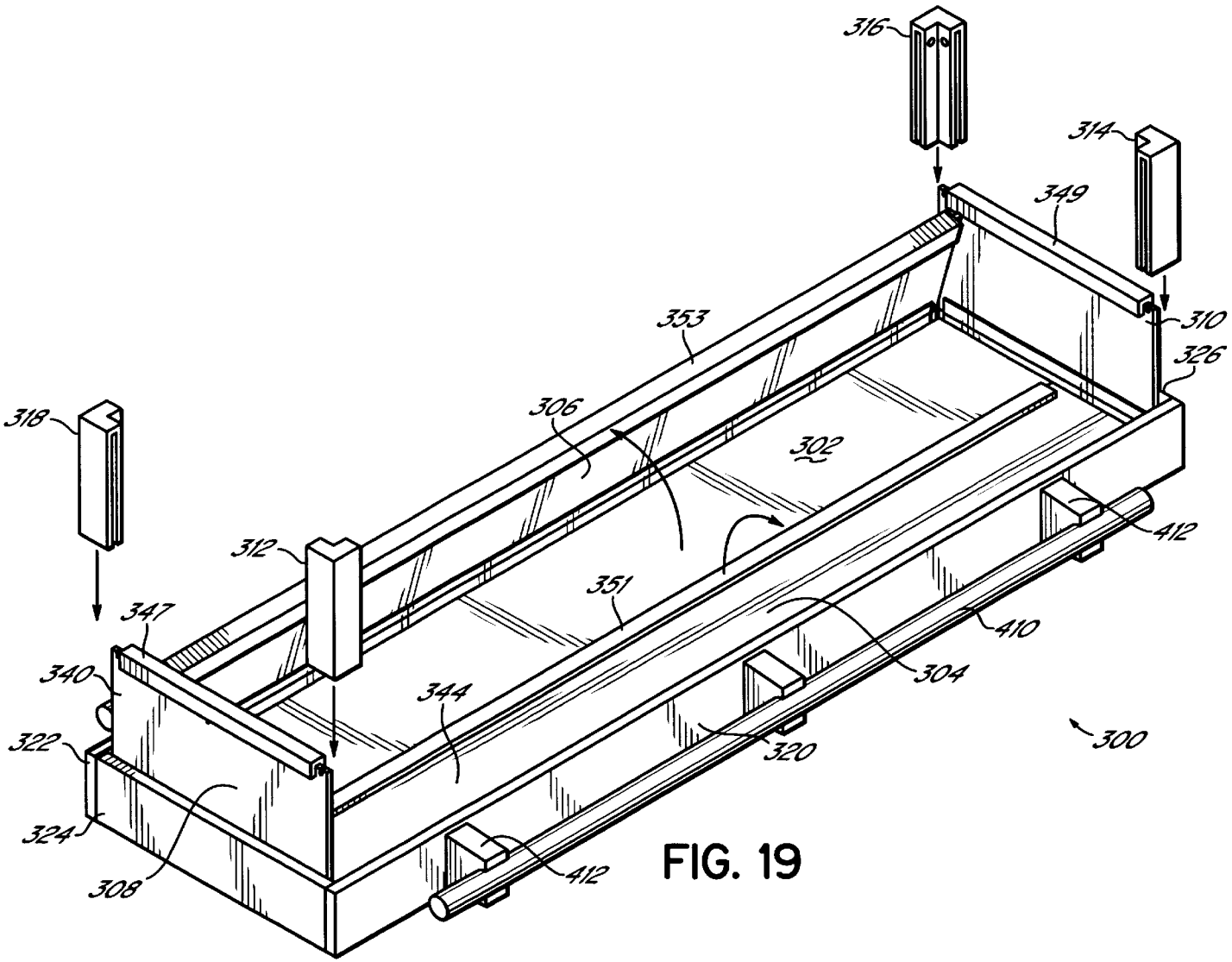
FIG. 19 is a perspective view of the cremation container of FIGS. 17 and 18 with end walls unfolded and illustrating the step of unfolding the pair of side walls and installing the comer angles.
Figure 20:
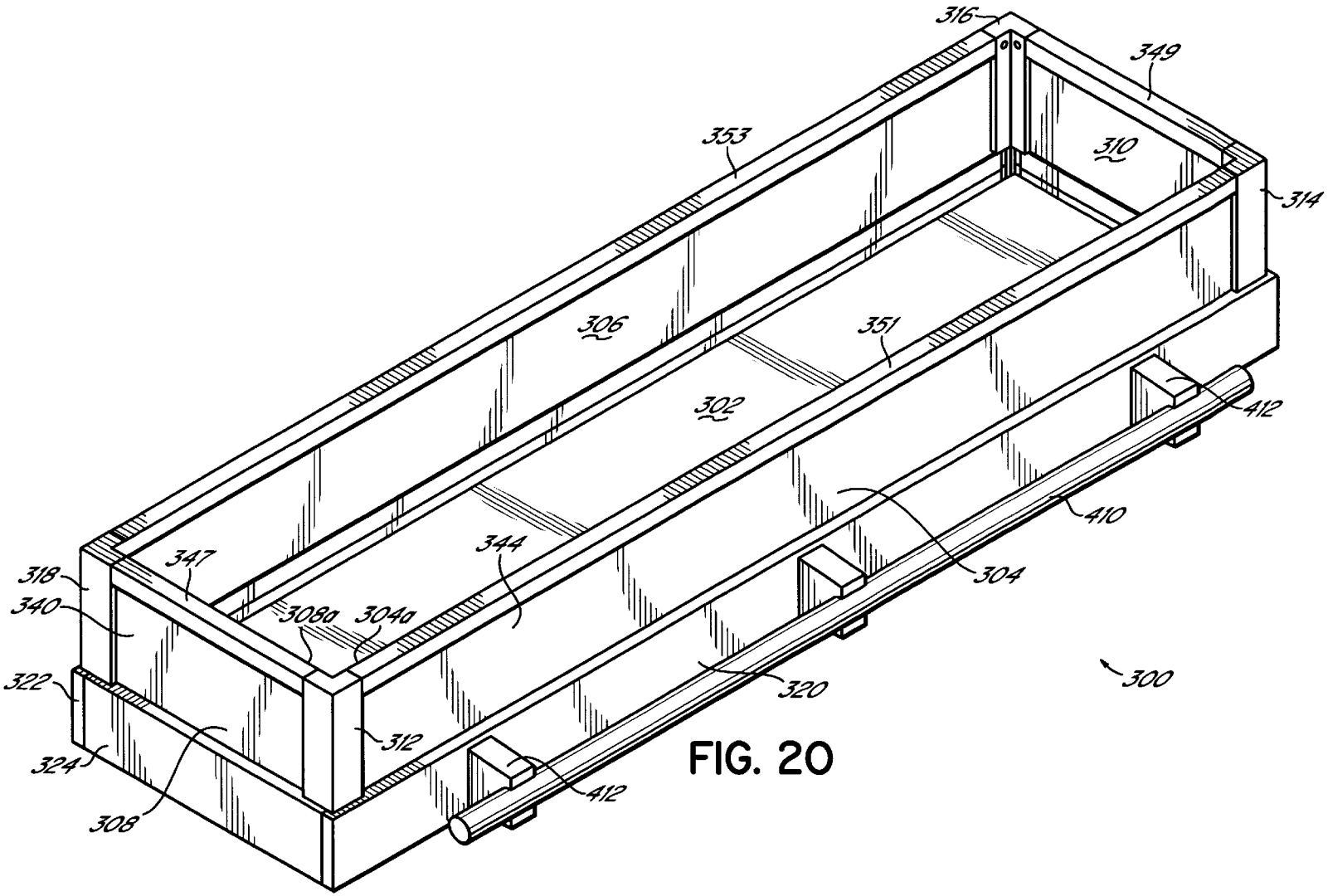
FIG. 20 is a perspective view of the cremation container of FIGS. 17–19 fully erected with corner angles installed.
Figure 21:
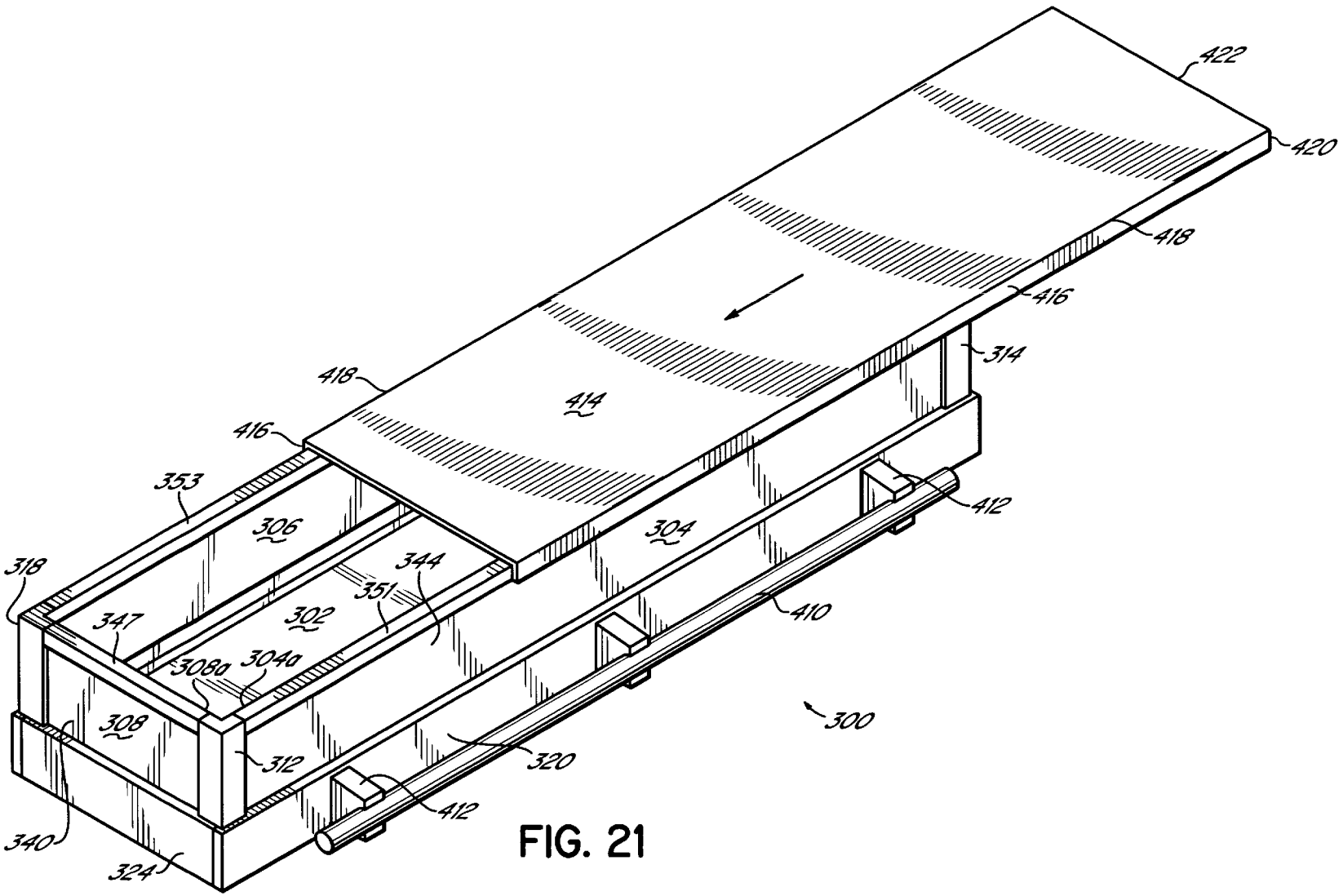
FIG. 21 is a view similar to FIG. 21 illustrating installation of the cover.
Figure 22:
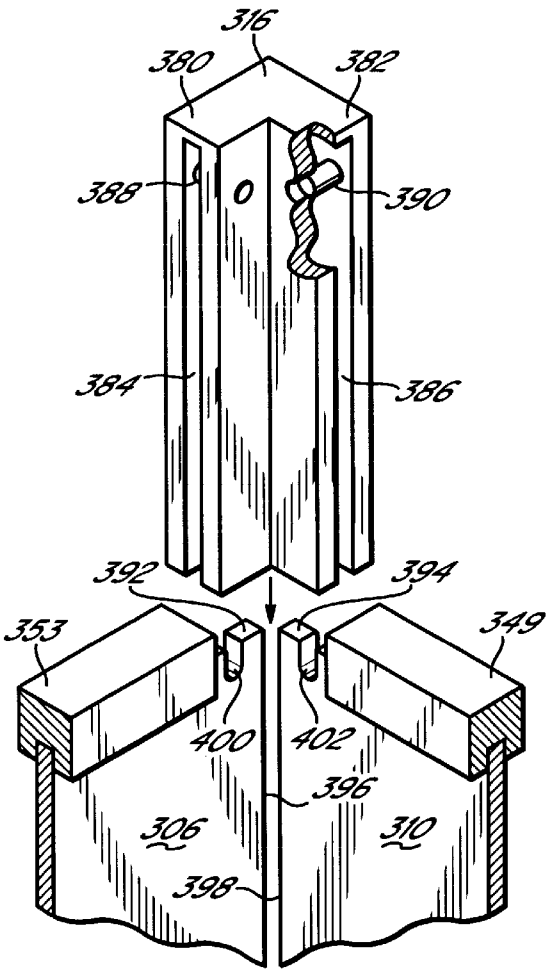
FIG. 22 is a partial perspective view, enlarged, of a corner of the cremation container of FIGS. 17–21 illustrating installation of the corner angles.

Referring now to FIGS. 19 and 22, angle 316 is illustrated in more detail. Angle 316 includes legs 380, 382 having slots 384, 386, respectively. Dowel pins 388, 390 extend transversely through slots 384, 386 and legs 380, 382, respectively. Top edges 392, 394 of respective ones of adjacent end edges 396, 398 of respective ones of adjacent side and end walls 306, 310 include notches 400, 402 therein for receiving respective ones of the dowel pins 388, 390.

A further feature of the FIGS. 17–22 embodiment is the provision of a pair of handles 410, 410 secured to base mold frame members 320, 322 via lugs 412 secured to said side base mold frame members.

Finally, cover 414 (FIG. 21) is preferably of the "shoe box" type enabling cover 414 to slide atop the upper edges of the end wall top mold frame members 347, 349 and side wall top mold frame members 351, 353. More particularly, cover 414 includes a depending lip 416 depending from each side 418 but a depending lip 420 depending from only one end 422, thus enabling cover 414 to readily slide over the side walls 304, 306 and end walls 308, 310. If desired, a pair of such covers can be utilized.

Thus, field assembly of the container 300 requires only that four components (angles) be assembled onto one factory assembled subassembly of bottom 302, side walls 304, 306 and end walls 308, 310 with no screws being required.

Those skilled in the art will readily recognize numerous adaptations and modifications which can be made to the present invention which will result in an improved cremation container, yet all of which will fall within the spirit and scope of the present invention as defined in the following claims. For example, the use of alternative materials is within the scope of the invention. For instance, hardboard, strandboard, particle board, flake board, plywood, solid wood and finger jointed wood may be utilized in the practice of the invention. In addition, while the invention has been referred to herein as a "cremation container," it is to be understood that the term embraces and the invention may be practiced as a burial casket (either above or below ground) or other body containment vessel. Accordingly, the invention is to be limited only by the scope of the following claims and their equivalents.

What is claimed is:

1. A cremation container foldable into a compact configuration for shipping comprising:

a bottom;

a pair of side walls pivoted relative to said bottom;

a pair of end walls pivoted relative to said bottom;

an angle interconnecting adjacent end edges of adjacent ones of said side and end walls; and a cover removably positionable atop said pair of side walls and said pair of end walls;

each said angle including slotted legs which receive said adjacent end edges of said adjacent ones of said side and end walls;

further including a pair of side base mold frame members and a pair of end base mold frame members and wherein said bottom comprises a panel with peripheral side and end edges retained in grooves in said pair of side base mold frame members and in said pair of end base mold frame members, respectively.

2. The cremation container of claim 1, one pair of said pair of side walls and said pair of end walls being foldable onto said bottom, the other pair of said pair of side walls and said pair of end walls being foldable onto said one pair of said pair of side walls and said pair of end walls, to thereby compactly configure said container for shipping.

3. The cremation container of claim 1 wherein said pair of side walls are foldable onto said bottom and said pair of end walls are foldable onto said pair of side walls.

4. The cremation container of claim 1 wherein each of said pair of end walls comprises an upper and a lower panel hingedly connected together, an end top mold frame member secured to an upper edge of said upper panel, said lower panel being secured to said end base mold frame member.

5. The cremation container of claim 4 wherein said upper and lower panels are hingedly connected together via a living hinge.

6. The cremation container of claim 5 wherein said living hinge is a cardboard living hinge.

7. The cremation container of claim 1 wherein each of said pair of side walls comprises an upper and a lower panel hingedly connected together, a side top mold frame member secured to an upper edge of said upper panel, said lower panel being secured to said side base mold frame member.

8. The cremation container of claim 7 wherein said upper and lower panels are hingedly connected together via a living hinge.

9. The cremation container of claim 8 wherein said living hinge is a cardboard living hinge.

10. The cremation container of claim 1 further including a pair of side top mold frame members and a pair of end top mold frame members.

11. The cremation container of claim 10 wherein each said angle abuts adjacent ones of said side and end base mold frame members and adjacent ones of said side and end top mold frame members.

12. The cremation container of claim 1 further including handles secured to said side base mold frame members.

13. The cremation container of claim 1 wherein said cover comprises:

opposed sides and opposed ends; and a depending lip secured to each said opposed side but to only one said end.

14. The cremation container of claim 1 wherein said cover comprises a pair of covers, each of which comprises:

opposed sides and opposed ends; and a depending lip secured to each said opposed side but to only one said end.

15. A cremation container foldable into a compact configuration for shipping comprising:

a bottom;

a pair of side walls pivoted relative to said bottom;

a pair of end walls pivoted relative to said bottom;

an angle interconnecting adjacent end edges of adjacent ones of said side and end walls; and a cover removably positionable atop said pair of side walls and said pair of end walls;

each said angle including slotted legs which receive said adjacent end edges of said adjacent ones of said side and end walls;

wherein each said slotted leg of each said angle includes a dowel pin extending transversely therethrough, and a top edge of each of said adjacent end edges of said adjacent ones of said side and end walls includes a notch extending therefrom for receiving a respective said dowel pin.

* * * * *